US007255416B2

(12) United States Patent
Usuda

(10) Patent No.: US 7,255,416 B2
(45) Date of Patent: Aug. 14, 2007

(54) LIQUID DROP EJECTING DEVICE AND METHOD FOR EJECTING LIQUID DROP, LIQUID DROP EJECTING HEAD DEVICE, METHOD AND MANUFACTURING METHOD FOR DEVICE

(75) Inventor: Hidenori Usuda, Matsumoto (JP)

(73) Assignee: Seiko Epson Corporation (JP)

( * ) Notice: Subject to any disclaimer, the term of this patent is extended or adjusted under 35 U.S.C. 154(b) by 260 days.

(21) Appl. No.: 10/800,135

(22) Filed: Mar. 12, 2004

(65) Prior Publication Data

US 2004/0239715 A1 Dec. 2, 2004

(30) Foreign Application Priority Data

Mar. 17, 2003 (JP) ..... 2003-072334

(51) Int. Cl.
*B41J 29/393* (2006.01)

(52) U.S. Cl. ..... 347/19

(58) Field of Classification Search ..... 347/14–15, 347/10–11, 19, 12
See application file for complete search history.

(56) References Cited

U.S. PATENT DOCUMENTS 6,116,714 A * 9/2000 Imanaka et al. ..... 347/19
6,257,685 B1 * 7/2001 Ishikawa ..... 347/10
6,286,923 B1 * 9/2001 Sugahara ..... 347/10
2005/0088469 A1 * 4/2005 Igarashi ..... 347/14
2006/0028499 A1 * 2/2006 Nakamura et al. ..... 347/12

FOREIGN PATENT DOCUMENTS

JP 8-324039 12/1996
JP 9-169131 6/1997
JP 2000-309131 11/2000
JP 2001-47646 2/2001

OTHER PUBLICATIONS

Patent Abstracts of Japan, 08-324039 (2 pages).
Patent Abstracts of Japan, 09-169131 (2 pages).
Patent Abstracts of Japan, 2001-047646 (2 pages).

* cited by examiner

*Primary Examiner*—K. Feggins
(74) *Attorney, Agent, or Firm*—Harness, Dickey & Pierce, P.L.C.

(57) ABSTRACT

The liquid drop ejecting device of the present invention comprises a head for ejecting a liquid drop and a controlling device for transmitting a driving signal COM and an ejection datum SI to the head. The head is provided with a memory for storing the ejection datum SI which is transmitted from the controlling device before ejecting the liquid drop. The head ejects the liquid drop according to the ejection datum SI which is stored in the memory and the driving signal which is transmitted from the controlling device. By doing this, it is possible to reduce the transmission of the datum from the controlling device to the liquid drop ejecting head device. Thus, it is possible to provide the liquid drop ejecting device which can manufacture various devices without disturbing the manufacturing efficiency.

3 Claims, 9 Drawing Sheets

LIQUID DROP EJECTING DEVICE AND METHOD FOR EJECTING LIQUID DROP, LIQUID DROP EJECTING HEAD DEVICE, METHOD AND MANUFACTURING METHOD FOR DEVICE

The present application is based on patent application Ser. No. 2003-72334 filed Mar. 17, 2003 in Japan, the content of which is incorporated herein by reference.

BACKGROUND OF THE INVENTION

1. Field of the Invention

The present invention relates to a liquid drop ejecting device for ejecting a liquid drop such as a liquid resin, a method for ejecting the liquid drop, a liquid drop ejecting head device. Also, the present invention relates to a device which is manufactured according to a method including at least a step for ejecting a liquid drop by using the above device and method for manufacturing a device such as a liquid display device, an organic electroluminescent (herein after called EL) display device, a color filter base board, a metal wiring, a micro-lens array, and an optical element having a coating layer.

2. Description of Related Art

Recently, it is more common that a liquid drop ejecting device for ejecting a fine liquid drop is used for manufacturing devices such an electronic apparatus having a very fine structure, an optical apparatus, etc. For example, a color liquid crystal display device as an electronic apparatus is provided with a color filter which is formed by ejecting fine liquid drops having colors such R (red), green (green), and B (blue) on a transparent base board such as a glass base board in a predetermined pattern by the liquid drop ejecting device. Also, a micro-lens array as an optical apparatus is formed by ejecting a plurality of fine liquid viscous transparent drops of resin on a plurality of sections on the transparent base board. Size and curvature of each micro-lens is controlled according to the time of disposition and the viscosity of the ejection.

Such a liquid drop ejecting device comprises a liquid drop ejecting head device having a liquid drop ejecting head for ejecting a liquid drop and a printing controller for processing the record datum for determining a position to which the liquid drop should be ejected on the base board and generating a driving waveform for driving the liquid drop ejecting head. The printing controller synchronizes the processed record datum and the generated driving waveform so as to transmit the record datum and the driving waveform respectively to the liquid drop ejecting head device. The liquid drop ejecting head device drives the liquid drop ejecting head according to the record datum and the waveform which are transmitted thereto respectively; thus, the controlling operation is performed for ejecting the liquid drop resin.

However, more recently, a larger liquid crystal display device having a finer resolution has been required. Therefore, the record datum which must be processed by the printing controller and transmitted to the liquid drop ejecting head device from the printing controller are increasing greatly. For such a requirement, there has been known a controlling technique for determining whether or not the record datum should be processed according to properties in the record datum (such as "monochrome datum or color datum"). Also, there has been known a technique for reducing a datum which is transmitted from the printing controlling device to the liquid drop ejecting head device by determining a portion in the record datum which is irrelevant to a printing operation so as to omit such an irrelevant portion.

However, the record datum which must be processed in the printing controlling device has increased more greatly recently; thus, there is a concern that a manufacturing efficiency depends on a time for transmitting the record datum from the printing controlling device to the liquid drop ejecting head device. That is, the liquid drop ejecting head can be operated all the time if the time for transmitting the datum from the printing controlling device to the liquid drop ejecting head device is shorter than the time for ejecting the liquid drop from the liquid drop ejecting head. In contrast, if the time for transmitting the datum from the printing controlling device to the liquid drop ejecting head device is longer than the time for ejecting the liquid drop from the liquid drop ejecting head, there is a concern that there is a time in which the liquid drop ejecting head is not operated such that the liquid drop may not be ejected from the liquid drop ejecting head; thus, the manufacturing efficiency may be reduced. Recently, such a case has actually occurred due to the increase of the datum.

In addition, in the above color filter or the micro-lens array, objects to be manufactured such as a pixel or a lens are disposed in a regulated disposition; therefore, it is quite common that the record datum is transmitted from the printing controller to the liquid drop ejecting head device for ejecting the fine liquid drop in a repeated manner. In conventional cases, the datum is transmitted inefficiently such that the record datum is transmitted from the printing controller to the liquid drop ejecting head device during ejecting the liquid drop with regardless to whether or not the record datum has periodicity. Also, there is a problem in that the datum may be converted erroneously and radiation noise may increase if the datum is transmitted more rapidly.

SUMMARY OF THE INVENTION

The present invention was made in consideration of the above problems. An object of the present invention is to provide a liquid drop ejecting device and a method therefor, a liquid drop ejecting head device by which it is possible to reduce the datum which is transmitted from the printing controller as a controlling device to the liquid drop ejecting head device and manufacture devices while maintaining a manufacturing efficiency. Also, another object of the present invention is to realize a method for manufacturing a device containing a step for ejecting the liquid drop by using the above devices so as to provide a device which is manufactured by using the above method.

In order to solve the above problems, in a first viewpoint of the present invention, a liquid drop ejecting device of the present invention comprises a liquid drop ejecting head device which is provided with a liquid drop ejecting head for ejecting a liquid drop, and a controlling device which transmits a record datum which determines whether or not the liquid drop is ejected from the liquid drop ejecting head device and a driving waveform for driving the liquid drop ejecting head. In this aspect of the present invention, it is characterized in that the liquid drop ejecting head device is provided with a storage section which stores a part of the record datum or an entire record datum.

According to the present invention, a part of the record datum or an entire record datum are stored in the storage section which is provided in the liquid drop ejecting head device such that the record datum which is stored in the storage section is read out so as to eject the liquid drop.

Therefore, it is not necessary that the record datum should be transmitted from the controlling device to the liquid drop ejecting head device during ejecting the liquid drop; thus, it is possible to reduce the record datum which is supposed to be transmitted to the liquid drop ejecting head device. Also, the record datum is not transmitted rapidly from the controlling device to the liquid drop ejecting head device during ejecting the liquid drop; thus, it is possible to prevent an erroneous conversion of the datum and the radiation noise which is caused by a noise during transmitting the datum.

Also, according to the present invention, it is characterized in that the liquid drop ejecting head device controls the liquid drop ejecting head according to the driving waveform which is transmitted from the controlling device and the record datum which is stored in the storage section.

Also, according to the present invention, it is characterized in that the controlling device transmits a part of the record datum or an entire record datum to the liquid drop ejecting head device before the liquid drop ejecting head device ejects the liquid drop such that the record datum be stored in the storage section.

According to the present invention, the record datum is transmitted from the controlling device to the liquid drop ejecting head device before the liquid drop is ejected from the liquid drop ejecting head device. Therefore, the ejecting operation for the liquid drop is not limited to a kind of the record datum which is stored in the storage device in advance; thus, it is possible to eject the liquid drop according to desirable kind of storage datum.

Also, according to the present invention, it is characterized in that the liquid drop ejecting head device is provided in the liquid drop ejecting device so as to be detachable therefrom.

In the present invention, the liquid drop ejecting head device is provided in the liquid drop ejecting device so as to be detachable therefrom; therefore, it is possible to employ a method in which a plurality of liquid drop ejecting head devices having a storage section in which a variety of different record data are stored are prepared in advance so as to exchange the liquid drop ejecting head device according to the manufacturing step. By employing such a method, it is not necessary to transmit the record datum from the controlling device to the liquid drop ejecting head device in the controlling device before the liquid drop is ejected; thus, it is possible to improve the manufacturing efficiency.

Also, in a second view point of the present invention, a liquid drop ejecting device comprises a liquid drop ejecting head device which is provided with a liquid drop ejecting head for ejecting a liquid drop, and a controlling device which transmits a record datum which determines whether or not the liquid drop is ejected from the liquid drop ejecting head device and a driving waveform for driving the liquid drop ejecting head. In this aspect of the present invention, it is characterized in that the liquid drop ejecting head device is provided with a storage controlling section which reads a part of the record datum or an entire record datum to from a detachable storage device and/or writes a part of the record datum or an entire record datum to a detachable storage device.

According to the present invention, the storage device is provided in the liquid drop ejecting head device so as to be detachable therefrom. Also, the storage controlling section reads a part of the record datum or an entire record datum to from a detachable storage device and/or writes a part of the record datum or an entire record datum to a detachable storage device. Therefore, there is an effect in that it is possible to eject the liquid drop according to variety of the record data only by exchanging the storage device. Also, it is not necessary to transmit the record datum from the controlling device to the liquid drop ejecting head device before the liquid drop is ejected by preparing a plurality of storage devices having different record data in advance so as to exchange the storage device according to the manufacturing step. Thus, it is possible to improve the manufacturing efficiency.

Also, in the second viewpoint of the present invention, it is characterized in that the liquid drop ejecting head device controls the liquid drop ejecting head according to the driving waveform which is transmitted from the controlling device and the record datum which is read from the detachable storage device by the storage controlling section.

Also, in the second viewpoint of the present invention, it is characterized in that the controlling device transmits a part of the record datum or an entire record datum to the liquid drop ejecting head device before the liquid drop ejecting head device ejects the liquid drop such that the record datum be stored in the storage device by the storage controlling section.

Also, a liquid drop ejecting head device comprises a liquid drop ejecting head which ejects a liquid drop, and a storage section which stores a part of the record datum or an entire record datum which determines whether or not the liquid drop ejecting head should eject the liquid drop.

A method for ejecting a liquid drop from a liquid drop ejecting head which is provided in the liquid drop ejecting head device comprises the steps for transmitting a driving waveform for driving the liquid drop ejecting head to the liquid drop ejecting head device, reading out the record datum from the storage device which is disposed in the liquid drop ejecting head device for determining whether or not the liquid drop should be ejected, and driving the liquid drop ejecting head device according to the driving waveform and the record datum.

A method for ejecting a liquid drop according to the present invention further comprises the step for writing the record datum in the storage device.

A method for manufacturing a device according to the present invention comprises a step for ejecting the liquid drop by using the above liquid drop ejecting device or above the method for ejecting the liquid drop.

A device of the present invention is manufactured according to the above method for manufacturing the device.

DETAILED DESCRIPTION OF THE INVENTION

A liquid drop ejecting device and a method therefor, a liquid drop ejecting head device, a device and a manufacturing method therefor are explained in detail according to an embodiment of the present invention with reference to drawings below.

General Structure of the Liquid Drop Ejecting Device

Figure 1:
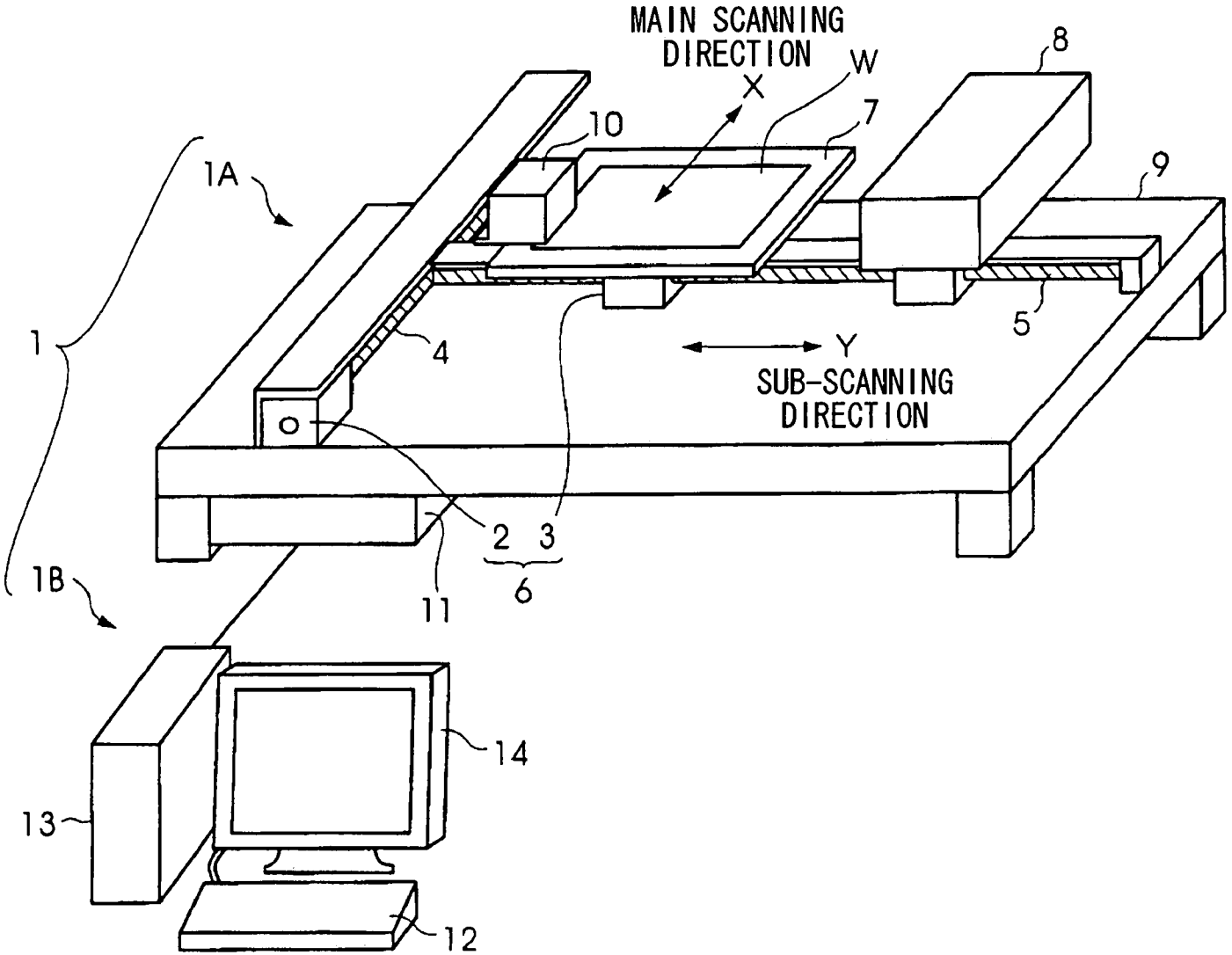
FIG. 1 is an isometric view for explaining a general structure of a liquid drop ejecting device according to an embodiment of the present invention.

FIG. 1 is an isometric view for showing a general structure of the liquid drop ejecting device according to an embodiment of the present invention. As shown in FIG. 1, a liquid drop ejecting device 1 comprises an ejecting device unit 1A and a computer 1B. The ejecting device unit 1A comprises an X-direction driving motor 2, a Y-direction driving motor 3, an X-direction driving axis 4, a Y-direction guide axis 5, a stage 7, a cleaning structure section 8, a base mount 9, a head 10, and a controlling device 11.

Also, the computer 1B comprises a keyboard 12, a computer unit 13, and a display device 14 such as a cathode-ray tube (hereinafter called a CRT) or a liquid crystal display device. The keyboard 12 serves for inputting a condition for determining which position on a base board W the liquid drop should be ejected by the ejecting device unit 1A. Also, the computer unit 13 comprises a central processing unit (hereinafter called a CPU), a random access memory (hereinafter called a RAM), and an external storage device such as a hard disk drive unit. The conditions for ejecting the liquid drop which are inputted via a recording medium such as a keyboard 12 and a flexible disk (hereinafter called an FD) are stored and recorded in the external storage device. It is possible to select the conditions for ejecting the liquid drop which are stored in the external storage device for instructing purpose to thereoutside via the keyboard 12, etc.

In the ejecting device unit 1A according to the present invention, a head 10 serves as a liquid drop ejecting head device. Here, the head 10 comprises the liquid drop ejecting head 28 (shown in FIG. 2) and a head driving circuit 29 (shown in FIG. 2) for driving the liquid drop ejecting head 28. The head 10 serves for ejecting a liquid resin which is supplied from a tank (which is not shown in the drawing) in which a liquid resin is stored via a pipe (path for supplying a liquid) from a nozzle on the head 10 under a liquid drop condition. The head 10 is detachable from the ejecting device unit 1A; thus, it is possible to replace the head 10 by other head according to the base board W and the variation of the liquid resin which is stored in the above tank if necessary.

The stage 7 serves for mounting a base board W thereon which is an object to which the liquid drop is ejected. The stage 7 has a structure for fixing the base board W on a predetermined reference position. The X-direction driving axis 4 is formed by, for example, a ball-screw. The X-direction driving motor 2 is connected to an end section of the X-direction driving axis 4. The X-direction driving motor 2 is a stepping motor, etc. The X-direction driving motor 2 rotates the X-direction driving axis 4 if a driving signal in an X-axis direction is supplied from the controlling device 11. When the X-direction driving axis 4 rotates, the head 10 moves in the X-direction along the X-direction driving axis 4.

The Y-direction guide axis 5 is also formed by a ball-screw, etc. so as to be fixed on a predetermined position in the base mount 9. The stage 7 is disposed on the Y-direction guide axis 5. The stage 7 is provided with the Y-direction driving motor 3. The Y-direction driving motor 3 is a stepping motor etc. The stage 7 moves in the Y-direction so as to be guided by the Y-direction guide axis 5 when the driving signal in the Y-direction is supplied to the Y-direction driving motor 3 from the controlling device 11. A head moving structure 6 is formed which moves the head 10 to a desirable position on the base board W by using the X-direction driving motor 2 and the Y-direction driving motor 3.

Head 10 and Controlling Device 11

Figure 2:
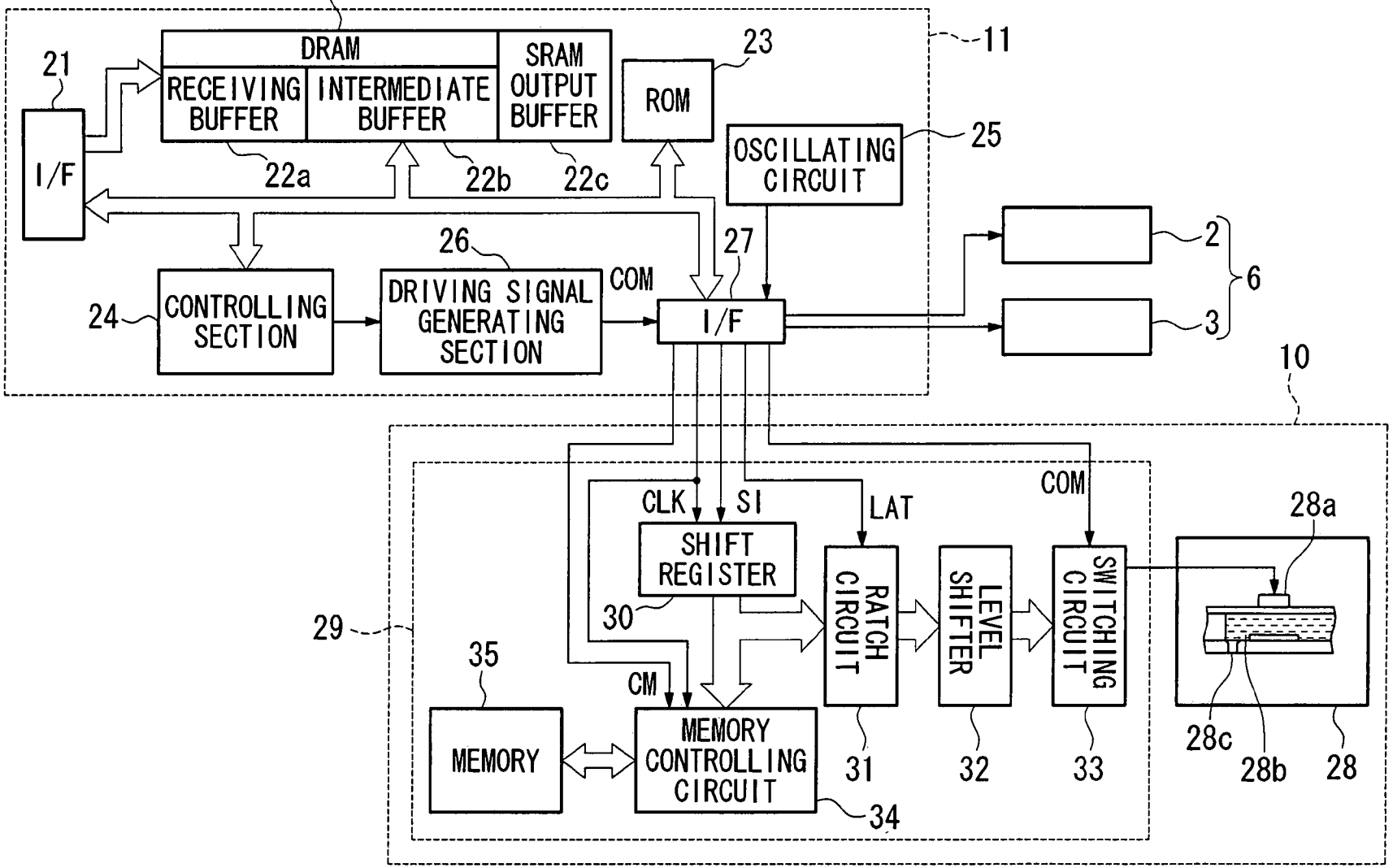
FIG. 2 is a block diagram for showing a head 10 and a controlling device 11 which are shown in FIG. 1.

Next, a head 10 and a controlling device 11 are explained in detail. FIG. 2 is a block diagram for showing a structure of the head 10 and the controlling device 11 shown in FIG. 1. In FIG. 2, the controlling device 11 which is disposed in the ejecting device unit 1A comprises a random-access memory (hereinafter called a RAM) 22 for recording various data which is formed by an interface 21 which receives a condition for ejecting the liquid drop from the computer 1B, a dynamic random-access-memory (hereinafter called a DRAM), and a static RAM (hereinafter called a SRAM), a ROM 23 in which a routine for processing various data, a controlling section 24 which is formed by a CPU, an oscillating circuit 25, a driving signal generating section 26 for generating a driving signal COM which is supplied to the head 10, and an interface 27. The interface 27 transmits an ejection datum as a record datum which is developed in a pattern datum to the head 10 and outputs the driving signal for driving the X-direction driving motor 2 and the Y-direction driving motor 3 to the head moving structure 6 respectively.

In the above controlling device 11, the ejection condition, etc. which are sent from the computer 1B are stored in a receiving buffer 22*a* which is disposed as a part of a RAM 22 via the interface 21. A command of the datum which is stored in the receiving buffer 22*a* is analyzed. After that, the datum which is stored in the receiving buffer 22*a* is sent to an intermediate buffer 22*b* which is disposed as a part of the RAM 22. The datum which is converted to an intermediate form of code by a controlling section 24 is stored in the intermediate buffer 22*b* such that the controlling section 24 performs an operation for adding an information for an ejection position of the liquid drop. Next, the controlling section 24 analyzes the datum in the intermediate buffer 22*b* so as to decode the datum in the intermediate buffer 22*b*. After that, the controlling section 24 deploys the dot pattern datum in an output buffer 22*c* so as to be recorded.

After a dot pattern datum which corresponds to a scanned portion by the head 10 is obtained, the dot pattern datum is transmitted to the head 10 via the interface 27 serially. After a dot pattern datum which corresponds to a scanned portion is outputted from the output buffer 22*c*, contents in the output buffer intermediate buffer 22*b* is erased and a next operation for converting the intermediate code is performed.

Also, a driving signal COM for driving the liquid drop ejecting head 28 which is disposed in the head 10 is generated by the driving signal generating section 26 so as to be transmitted to the head 10 via the interface 27. Furthermore, an ejection datum SI which is deployed in the dot pattern datum is outputted to the head driving circuit 29 serially which is disposed in the head 10 via the interface 27 so as to be synchronized with a clock signal CLK from the oscillating circuit 25. In addition to the above ejection datum SI, the driving signal COM, and the clock signal CLK, a latch signal LAT and a memory controlling signal CM which are explained later are outputted from the interface 27 to the head driving circuit 29 which is disposed in the head 10.

The head driving circuit 29 which is disposed in the head 10 comprises a shift register 30, a latch circuit 31, a level shifter 32, a switching circuit 33, a memory controlling circuit 34, and a memory 35. Here, FIG. 2 represents simplified structure; thus, every members above are not shown in detail. That is, a plurality (for example, 180 pieces) of liquid drop ejecting heads 28 are disposed in the head 10. Also, a plurality of switching elements (not shown in the drawing) are disposed in the switching circuit 33 so as to correspond to each liquid drop ejecting head 28 respectively.

The above shift register 30 converts the ejection datum SI which is tramsmitted from the controlling device 11 in serial/parallel manner. The latch circuit 31 latches the ejection datum SI which is converted in parallel manner by the shift register 30 when a latch signal LAT is outputted from the controlling device 11. The level shifter 32 increases a voltage of the ejection datum SI which is outputted from the latch circuit 31 to a predetermined level, for example, several tens volts such that it is possible to drive the switching circuit 33.

The switching circuit 33 controls the determination for whether or not the driving signal COM should be supplied to the liquid drop ejecting head 28 according to the ejection datum SI which is outputted from the level shifter 32. That is, the driving signal COM is charged to the corresponding liquid drop ejecting head 28 during a period in which a voltage level of the ejection datum SI which is applied to each switching element which is disposed in the switching circuit 33 indicates "1 (one)". The driving signal COM is blocked so as not to applied to the corresponding liquid drop ejecting head 28 during a period in which a voltage level of the ejection datum SI indicates "0 (zero)".

The memory controlling circuit 34 stores the ejection datum SI which is transmitted from the controlling device 11 to the head driving circuit 29 so as to be outputted from the shift register 30 in the memory 35 as a storage section in the present invention. The memory control signal CM controls the determination for whether or not the ejection datum SI should be stored in the memory 35. Also, if a common memory is used for the memory 35, a bit width in inputting and outputting end for the datum is fixed to 8, 16, or 32 bit. Therefore, the memory controlling circuit 34 controls for adjusting the bit width of the inputting and outputting end for the datum in the memory 35 to the bit width of the output end of the shift register 30.

That is, if the bit width in inputting and outputting end for the datum in the memory 35 is narrower than the bit width of the output end of the shift register 30, the ejection datum SI which is received from the shift register 30 is divided so as to correspond to the bit width in inputting and outputting end for the datum in the memory 35; thus, the divided ejection datum SI is stored in the memory 35 over several times. In contrast, if the datum is read out of the memory 35, the divided ejection datum SI is read out over several times such that the divided ejection datum SI should be restored so as to correspond to the bit in the output end of the shift register 30 and outputted. Here, if the ejection datum SI is stored in the memory 35, the latch signal LAT is not outputted from the interface 27 to the latch circuit 31.

Also, the memory controlling circuit 34 reads out the ejection datum 35 which is stored in the memory 35 according to the memory controlling signal CM. The above memory 35 is not limited to a particular memory as long as the memory can store the ejection datum SI. Therefore, it is acceptable to use a storage device such as a hard disk. Here, a storage device should preferably be a RAM, a programmable read only memory (hereinafter called a PROM), an an on-time PROM (hereinafter called an OTP) if a read-out speed, dimension, and weight are taken into account.

Here, the memory 35 is disposed in the head driving circuit 29 so as to store the ejection datum SI for the purpose of reducing the transmission amount and transmission speed of the datum from the controlling device 11 to the head driving circuit 29 during ejecting the liquid drop. That is, if it takes a time for transmitting the ejection datum SI during ejecting the liquid drop than the time for ejecting the liquid drop, the liquid drop is not ejected from a liquid drop ejecting head 28; thus, there is a period in which the liquid drop ejecting head stops its operation. Therefore, the manufacturing efficiency decreases. In order to prevent such a problem, if the speed for transmitting the datum increases, there are problems in that the datum may be converted erroneously or the radiation noise may increase. In order to prevent such problems, in the present embodiment, the ejection datum SI is transmitted to the head driving circuit 29 in the head 10 in advance so as to be stored in the memory 35 such that the ejection datum SI should be read out of the memory 35 when the liquid drop is ejected; thus, the ejection of the liquid drop by the liquid drop ejecting head 28 is controlled.

It may be acceptable if the ejection datum SI which is supposed to be stored in the memory 35 represent all the ejection data SI which are used when the liquid drop is ejected onto the base board W. However, it should be understood that the ejection datum SI be repeated at a constant periodicity for manufacturing a liquid crystal display device (color filter) or a micro-lens. Therefore, for such a case, if only the ejection datum SI which corresponds to the periodicity is stored in the memory 35 and such an ejection datum SI which corresponds to a periodicity is used repeatedly, it is further possible to shorten the time for transmitting the ejection datum SI from the controlling device 11 to the head 10.

Here, if a writing operation and a read-out operation by the memory controlling circuit 34 onto the memory 35 are stopped by the memory controlling signal CM, it is possible to eject the liquid drop compatibly while transmitting the ejection datum SI from the controlling device 11 to the head 10 in a similar manner to a conventional case. As explained above, in the present embodiment, it is possible to reduce the amount of the ejection datum SI which is transmitted from the controlling device 11 to the head 10 while using the conventional controlling device 11 as usual without modifying the structure of the conventional liquid drop ejecting device greatly. Therefore, it is not necessary to disuse the controlling device 11 for the purpose of modifying the structure of the device. Thus, there is not undesirable effect to a circumstance therearound.

Liquid Drop Ejecting Method

General operations for ejecting the liquid drop while transmitting the ejection datum SI from the controlling device 11 to the head 10 are as follows in the head driving circuit 29 which is explained above. That is, the ejection datum SI is transmitted in a serial manner from the controlling device 11 to the head driving circuit 29. The ejection datum SI is inputted to the shift register 30 so as to be converted in a serial/parallel manner. When the latch signal LAT is outputted from the controlling device 11 to the latch circuit 31, the latch circuit 31 latches the ejection datum SI which is converted by the shift register 30 in a parallel manner. The voltage of the ejection datum SI which is latched by the latch circuit 31 is increased to a predetermined level such as several tens volts such that the level shifter 32 can drive the switching circuit 33. The ejection datum SI having the increases voltage is outputted to the switching circuit 33. A plurality of switching elements which are disposed so as to correspond to the ejection data SI which are outputted from the level shifter 32 are turned on or off. The driving signal COM is supplied to the liquid drop ejecting head 28 which corresponds to the switching element which is turned on; thus, the liquid drop is ejected.

In order to transmit the ejection datum SI from the controlling device 11 to the head 10 so as to be stored in the memory 35 before the liquid drop is ejected, the ejection datum SI is transmitted in a serial manner from the controlling device 11 to the head driving circuit 29 similarly to the above case. Next, the ejection datum SI is converted in serial/parallel manner by the shift register 30. Consequently, the memory controlling signal CM is outputted to the head driving circuit 29 instead of outputting the latch signal LAT from controlling device 11 to the head driving circuit 29. The ejection datum SI which is converted in a parallel manner in the shift register 30 enters the memory controlling circuit 34 so as to be written in the memory controlling circuit 34. Such operations are repeated; thus, the ejection datum SI is memory 35 successively (Step for writing).

In order to eject the liquid drop by using the ejection datum SI which is stored in the memory 35, the memory controlling signal CM is outputted from the controlling device 11 to the head driving circuit 29. Consequently, the ejection datum SI which is stored in the memory 35 is read out by the memory controlling circuit 34 (Step for reading-out). Here, the ejection datum SI which is read out in the memory 35 is a parallel datum.

Next, the latch signal LAT is outputted from the controlling device 11 to the head driving circuit 29 such that the latch circuit 31 latches the ejection datum SI which is read out by the memory controlling circuit 34.

The voltage of the ejection datum SI which is latched by the latch circuit 31 is increased to a predetermined level such as several tens volts such that the level shifter 32 can drive the switching circuit 33 so as to be supplied to the switching circuit 33. Also, a driving signal COM is supplied from the controlling device 11 to the switching circuit 33 (step for transmitting). A plurality of switching elements which are disposed in the switching circuit 33 turned on or off according to the ejection datum SI which is supplied thereto. The driving signal COM is supplied to the liquid drop ejecting head 28 which corresponds to the switching element which is turned on; thus, the liquid drop ejecting head 28 is driven so as to eject the liquid drop (step for driving).

The timing for reading out the ejection datum SI from the memory 35 is controlled by the memory controlling signal CM which is outputted from the controlling device 11 during ejecting the liquid drop. Thus, the ejection datum is read out from the memory 35 successively so as to perform the above operations. Also, if the ejection datum SI is repeated at a predetermined period and only the ejection datum SI which corresponds to a periodicity is stored in the memory 35, the ejection datum SI is read out repeatedly from the memory 35 during ejecting the liquid drop.

Liquid Drop Ejecting Head 28

Figure 3:
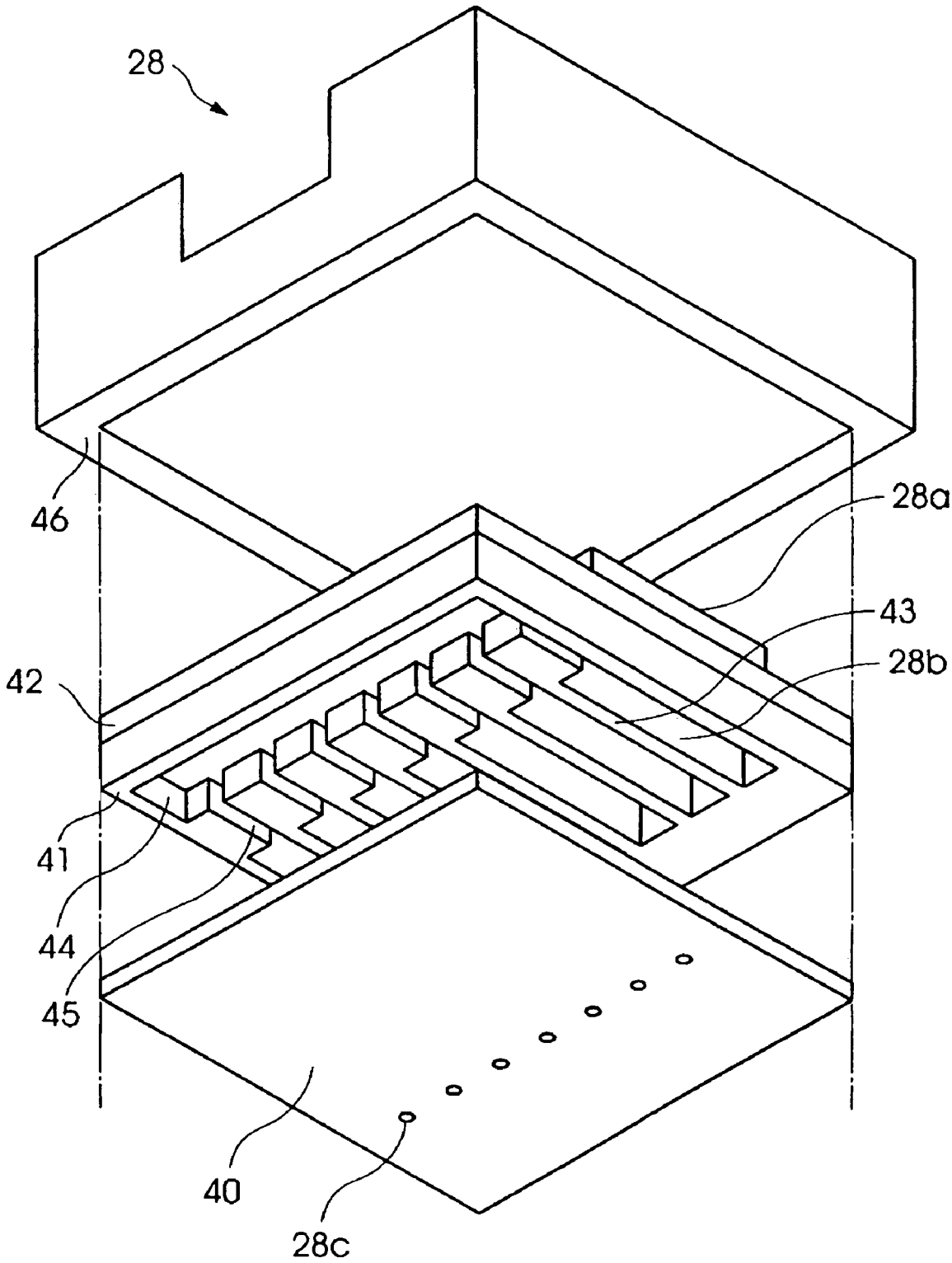
FIG. 3 is an isometric view of a liquid drop ejecting head 28 in a disassembled manner.
Figure 4A:
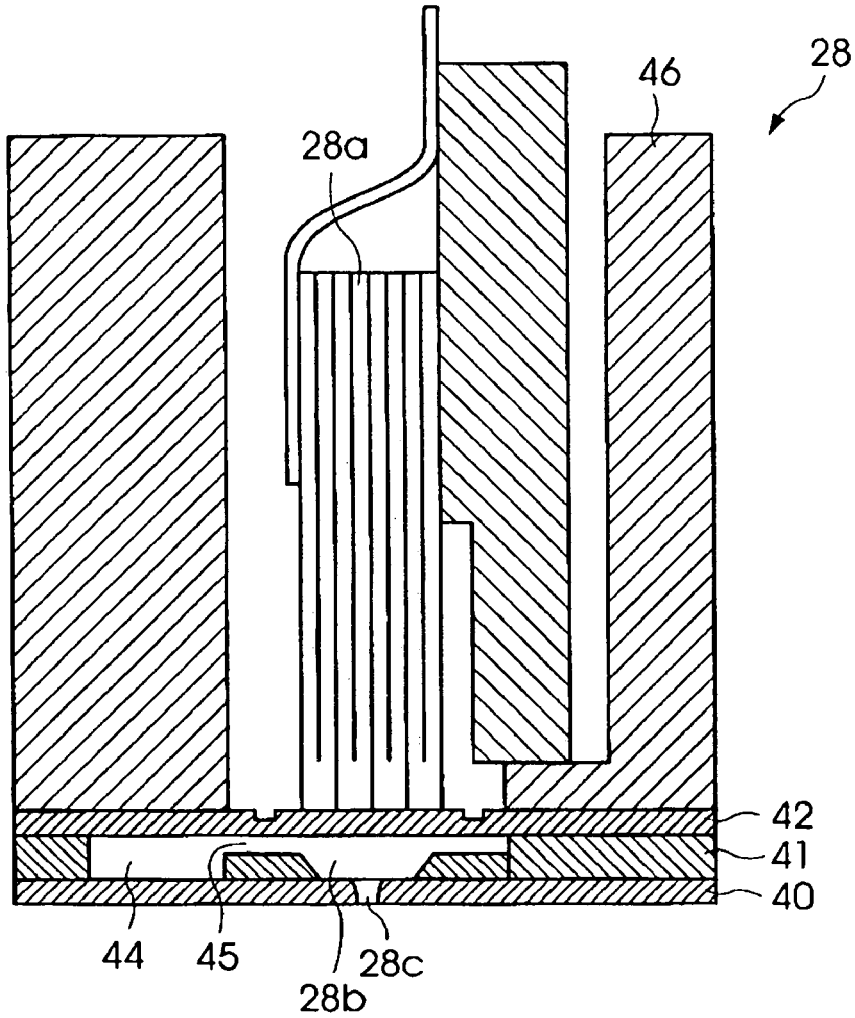
FIGS. 4A and 4B are views for explaining a liquid drop ejecting head 28.
Figure 4B:
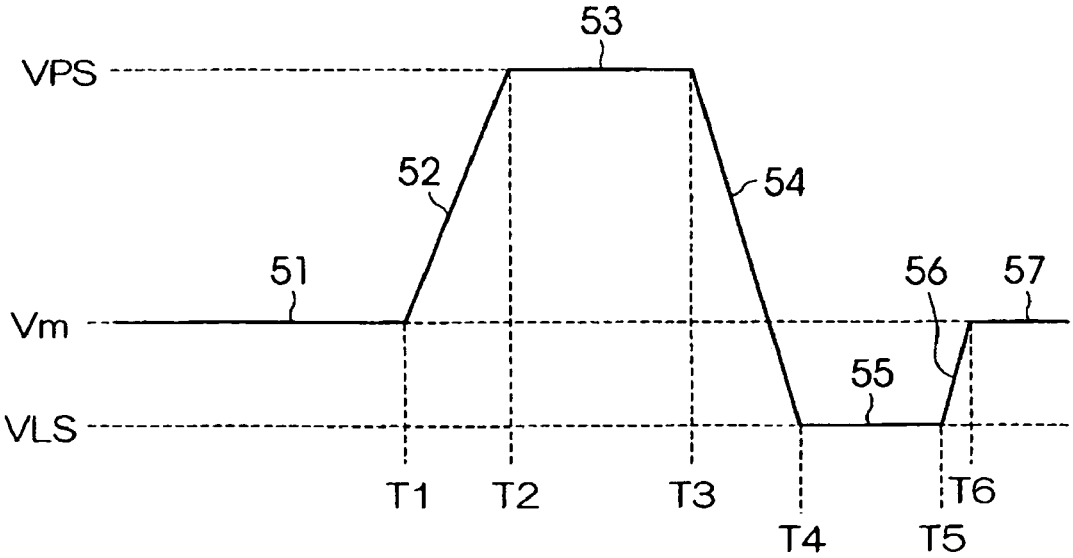

Next, a structure of the liquid drop ejecting head 28 is explained briefly. FIG. 3 is an isometric view for showing a general structure of the liquid drop ejecting head 28. Also, FIGS. 4A and 4B are views for explaining the liquid drop ejecting head 28. FIG. 4A is a cross section of an actuator which is formed in the liquid drop ejecting head 28 shown in FIG. 3. FIG. 4B shows a basic waveform of a driving signal which is applied to a pressure generating element 28*a* which is disposed in the actuator shown in FIG. 4A.

As shown in FIGS. 3 and 4A, the liquid drop ejecting head 10 comprises a nozzle forming plate 40, a pressure generating chamber 41, and a vibrating plate 42. The pressure generating chamber 41 comprises a pressure generating chamber 28*b*, a side wall 43 (partition wall), a reservoir 44, and an introduction path 45. The pressure generating chamber 28*b* etc. are formed in the pressure generating chamber 41 by etching the base board such as a silicon member. The pressure generating chamber 28*b* serves for a space for storing the liquid drop which is about to be ejected. The side wall 43 is formed so as to separate the pressure generating chambers 28*b*. The reservoir 44 serves for a flow path for replenishing the liquid drop in the pressure generating chamber 28*b*. The introduction path 45 is formed so as to introduce the liquid drop from the reservoir 44 to each pressure generating chamber 28*b*.

The nozzle forming plate 40 is attached ton a surface of the pressure generating chamber 41 by an organic bonding agent or a non-organic bonding agent such that a nozzle 28*c* should be disposed so as to correspond to the pressure generating chamber 28*b* which is formed on the pressure generating chamber 41. The pressure generating chamber 41 which is made by attaching the nozzle forming plate 40 thereto is contained in a casing 46 so as to form the head 10. The vibrating plate 42 is formed by a thin flexible plate so as to be attached to the another surface of the pressure generating chamber 41 by the organic bonding agent or the non-organic bonding agent. The pressure generating element 28*a* is disposed so as to correspond to each pressure generating chamber 28*b* on the vibrating plate 42. Here, it is possible to use a piezoelectric resonator (hereinafter called a PZT) for the pressure generating element 28*a*.

Here, the pressure generating element 28*a* is not limited to the PZT which has a vertically-vibrating-horizontally-effective property shown in FIGS. 4A and 4B; thus, it is possible to use a flexible oscillating PZT for the pressure generating element 28*a*. Also, the pressure generating element 28*a* is not limited to the piezoelectric resonator; thus, it is acceptable to use other element such as a magneto striction element. Also, it is acceptable to employ a structure in which the liquid drop is heated by a heat source such as a heater so as to change the pressure by bubbles which are generated in the heating operation. That is, it is possible to employ any structure as long as the element can generate a fluctuation of pressure in a pressure generating chamber which is explained later according to the signal which is applied from thereoutside.

Next, a basic waveform of a driving pulse which forms the driving signal COM is explained with reference to FIG. 4B. In FIG. 4B, the driving signal COM which activates the pressure generating element 28*a* increases to the maximum potential VPS by a constant inclination (charging pulse 52) during the time between time T1 and time T2 after the voltage value starts from an intermediate potential Vm (hole pulse 51) basically. During the time between time T2 and time T3, the maximum potential VPS maintains for a predetermined period (hold pulse 53). Next, the voltage value decreases at a constant inclination to the minimum potential VLS during a period between time T3 to time T4 (discharging pulse 54). After that, the minimum potential VLS maintains only for a predetermined period between time T4 to time T5 (hold pulse 55). Consequently, the voltage value increases to the intermediate potential Vm at a constant inclination during a period between time T5 to time T6 (charging pulse 56).

Figure 5A:
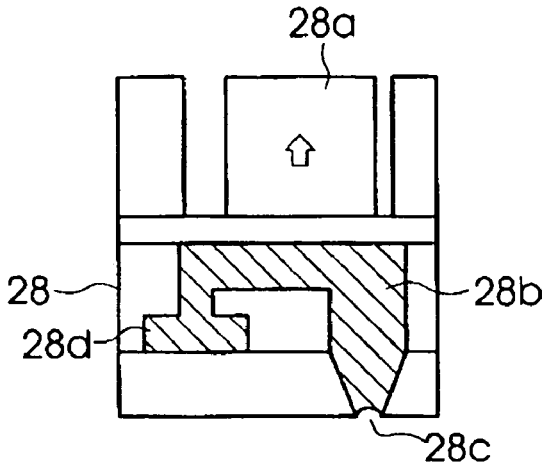
FIGS. 5A to 5C are views for explaining operations in the liquid drop ejecting head 28 during ejecting the liquid drop.
Figure 5B:
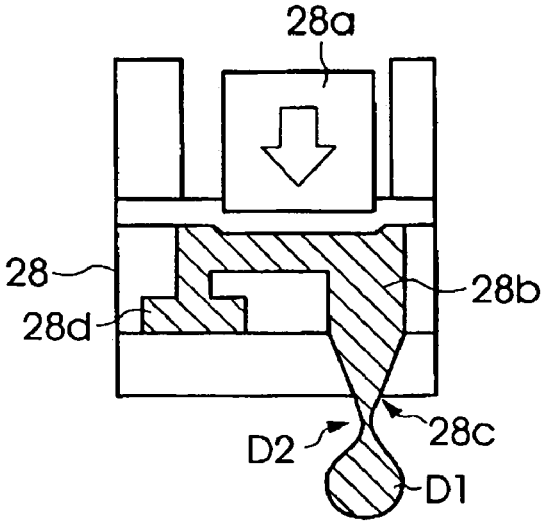
Figure 5C:
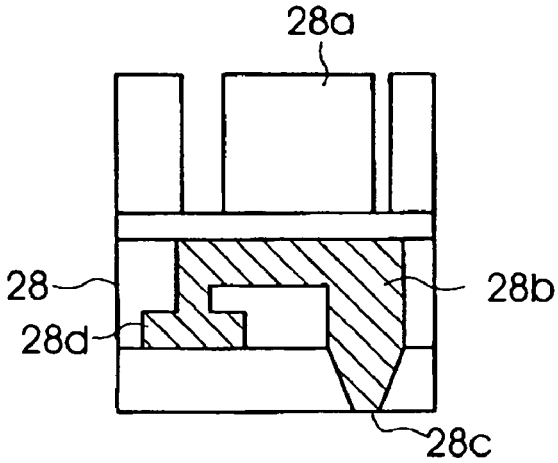

When the driving signal COM which is explained above is supplied to the liquid drop ejecting head 28, the liquid drop ejecting head 28 performs operations shown in FIGS. 5A to 5C so as to eject the liquid drop. FIGS. 5A to 5C are views for showing operations during which the liquid drop ejecting head 28 ejects the liquid drop. First, the charging pulse 52 in which the voltage value of the driving signal COM increases gently during a period during time T1 to time T2 shown in FIG. 4B is applied to the pressure generating element 28*a*, the pressure generating element 28*a* which is disposed in the liquid drop ejecting head 28 bends gradually toward a direction such that the capacity in the pressure generating chamber 28*b* increases as shown in FIG. 5A; thus, a negative pressure is generated in the pressure generating chamber 28*b*. By doing this, a liquid resin is supplied from the liquid drop ejecting head 28*d* to the pressure generating chamber 28*b*. Also, as shown in the drawings, the liquid resin which is disposed near an aperture of the liquid drop ejecting head 28*c* is attracted toward the pressure generating chamber 28*b* slightly; thus, the meniscus is attracted in the liquid drop ejecting head 28*c*.

Next, the hold pulse 53 which maintains the voltage value of the driving signal COM at the maximum potential VPS during a period between the time T2 to time T3 is applied to the pressure generating element 28*a*. After that, the discharging pulse 54 is applied to the pressure generating element 28*a* during a period between the time T3 to time T4. The pressure generating element 28*a* bends rapidly in a direction such that capacity in the pressure generating chamber 28*b* contracts; thus, a positive pressure is generated in the pressure generating chamber 28*b*. By doing this, as shown in FIG. 5B, a liquid drop D1 is ejected from the liquid drop ejecting head 28*c*.

When the liquid drop D1 is ejected, the hold pulse 55 which maintains the minimum potential VLS is applied during a period between a time T4 to T5. After that, the charging pulse 56 which increases to the intermediate potential Vm at a constant inclination during a period between a time T5 to time T6 is applied to the pressure generating element 28*a*. When the charging pulse 56 is applied to the pressure generating element 28*a*, the pressure generating element 28*a* deforms as shown in FIG. 5C; thus, a negative pressure is generated in the pressure generating chamber 28*b*. By doing this, the liquid resin is supplied from the liquid drop ejecting head 28*d* to the pressure generating chamber 28*b*. Simultaneously, the liquid resin near an aperture of the liquid drop ejecting head 28*c* is attracted toward the pressure generating chamber 28*b* slightly; thus, the meniscus is maintained under a constant condition as shown in FIG. 5C.

OTHER EMBODIMENT

The liquid drop ejecting device, a liquid drop ejecting head device, and a method therefor according to the embodiment of the present invention are explained above. However, more importantly, it should be understood that the present invention is not limited to the above embodiment. That is, the invention disclosed herein is susceptible to various modifications and alternative forms. For example, in the above embodiment, the ejection datum SI is transmitted from the controlling device 11 to the head 10 before the liquid drop is ejected from the head 10.

However, the head 10 is detachable from the ejecting device unit. Therefore, it is acceptable if a writing device for transmitting the ejection datum SI to the head 10 is disposed in addition to the controlling device 11 so as to transmit the ejection datum SI from the writing device so as to store the ejection datum SI in the memory 35. By doing this, there is not an ejection datum SI which is transmitted from the controlling device 11 to the head 10. Here, for the writing device which is disposed in addition to the controlling device 11, for example, it is possible to name a computer which has an interface which is similar to the interface 27 which is provided in the controlling device 11 which is shown in FIG. 2.

Here, in the above embodiment, the ejection datum SI is transmitted from the controlling device 11 to the head 10; therefore, it should be understood certainly that the controlling device 11 acknowledges a variation for the ejection data SI which are stored in the memory 35 in the head 10. However, if the ejection datum SI is stored in the memory 35 by using the writing device which is disposed in addition to the controlling device 11, the controlling device 11 cannot acknowledge the variation of the ejection data SI which are stored in the memory 35 in the head 10.

In the present embodiment, the driving signal COM is transmitted from the controlling device 11 to the head 10 during ejecting the liquid drop when the liquid drop is ejected by using the ejection datum SI which is stored in the memory 35. Therefore, it is necessary that the controlling device 11 should acknowledge the variation of the ejection datum SI which is stored in the memory 35.

In order to satisfy the above requirement, it is preferable that the controlling device 11 can acknowledge the variation of the ejection datum SI which is stored in the memory 35 in the head 10 by setting an identification number which is identified for each variation of the ejection datum SI which is stored in the memory 35 in advance so as to transmit the identification number which represents the variation of the ejection datum SI which is stored i the memory 35 in the head 10 which is attached to the liquid drop ejecting device 1 from the computer 1B to the controlling section 24 in the controlling device 11 shown in FIG. 1. The controlling section 24 can generate the driving signal COM in the driving signal generating section 26 such that the driving signal COM should correspond to the variation of the ejection datum SI according to the identification number.

Also, it may be acceptable that the identification number which indicates the variation of the ejection datum SI is stored in the memory 35 together with the ejection datum SI when the ejection datum SI is stored in the memory 35 in the head 10 by using the above writing device. In such a case, it may be acceptable that the memory controlling circuit 34 reads out the identification number which is stored in the memory 35 according to the memory controlling signal CM so as to transmit the identification number to the controlling section 24 in the controlling device 11 such that the memory controlling signal CM is outputted to the memory controlling circuit 34 in the head 10 which is attached to the controlling section 24 in the controlling device 11 when the head 10 is attached to the liquid drop ejecting device 1. By doing this, the controlling section 24 can acknowledge the variation of the ejection datum SI which is stored in the memory 35 in the head 10.

Furthermore, in the above embodiment, the memory 35 is disposed in the head 10. More importantly, it may be acceptable if the memory 35 is detachable from the head 10. In such a case, the memory 35 is detached from the head 10 such that the ejection datum SI is stored in the memory 35 by using the above writing device. In such a case, it is necessary to disposed a circuit in the above writing device such that the circuit should be similar to the memory controlling circuit 34 which is disposed in the head 10.

EXAMPLE 1 FOR LIQUID DROP EJECTING DEVICE

Figure 6:
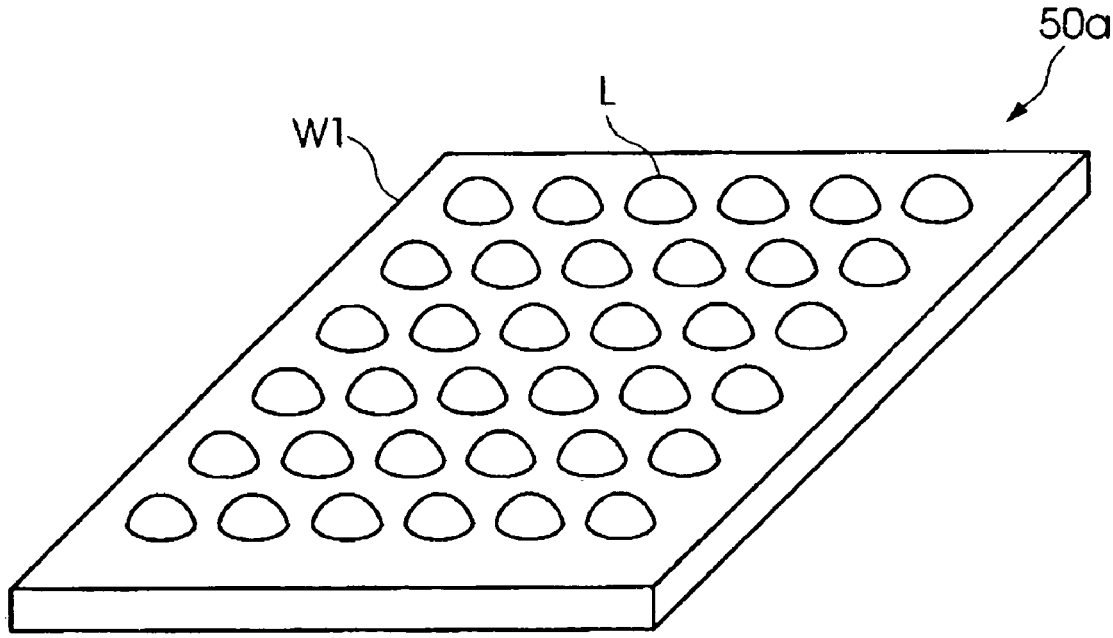
FIG. 6 is a view for explaining a micro-lens array which is used for an optical interconnection device which is manufactured by the liquid drop ejecting device 1 which is shown in FIG. 1.
Figure 7:
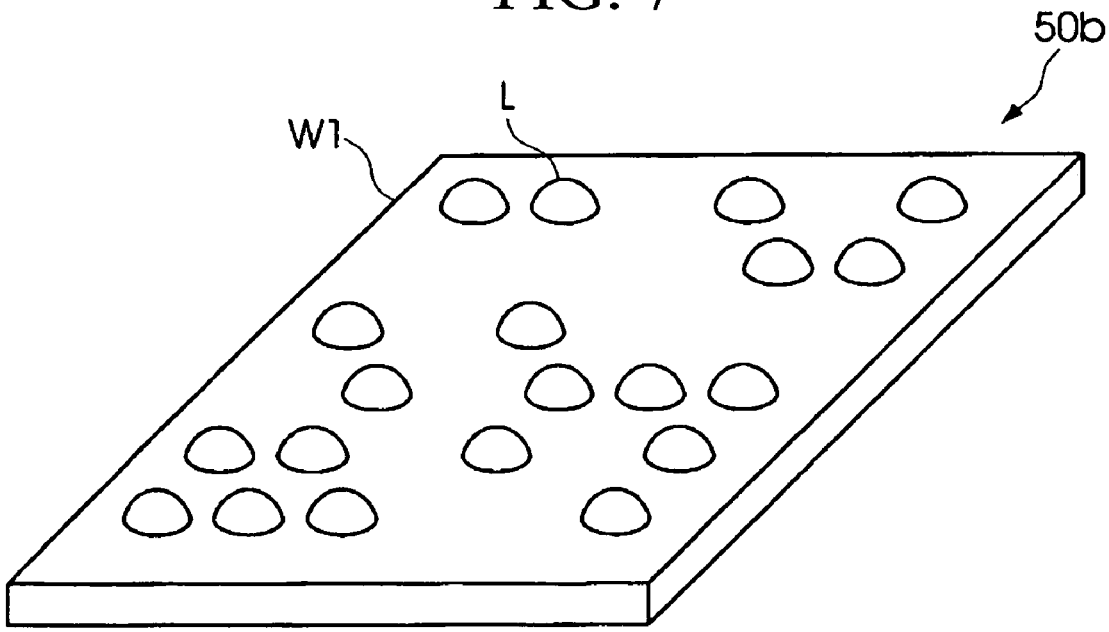
FIG. 7 is a view for explaining a micro-lens array which is used for an optical interconnection device which is manufactured by the liquid drop ejecting device 1 which is shown in FIG. 1.

FIGS. 6 and 7 are views for explaining a micro-lens array which is used for an optical interconnection device which is manufactured by the liquid drop ejecting device 1 shown in FIG. 1. In the liquid drop ejecting device 1, a photosensitive transparent resin (liquid drop) is ejected from the liquid drop ejecting head 10 onto a predetermined position on the transparent base board W as shown in FIGS. 6 and 7. After that, the photosensitive transparent resin is hardened by an ultra-violet ray so as to form a micro-lens D having a predetermined size on a predetermined position on the transparent base board. By doing this, it is possible to manufacture micro-lens arrays 100A and 100B which are used for the optical interconnection device.

Here, in the micro-lens array 100A shown in FIG. 6, the micro-lenses D is disposed in the X-direction and the Y-direction in a matrix manner. Also, in the micro-lens array 100B shown in FIG. 7, the micro-lenses D is disposed in the X-direction and the Y-direction in an irregular dispersed manner. Here, the micro-lens array is used not only for an optical interconnection device but also for a liquid crystal panel. If the device which employs an ink-jet method in which the present invention is applied is used for manufacturing the micro-lens which is used for the liquid crystal device, it is not necessary to use a photolithographic technique; therefore, it is possible to improve the manufacturing efficiency for the micro-lens array.

EXAMPLE 2 FOR LIQUID DROP EJECTING DEVICE

Figure 8:
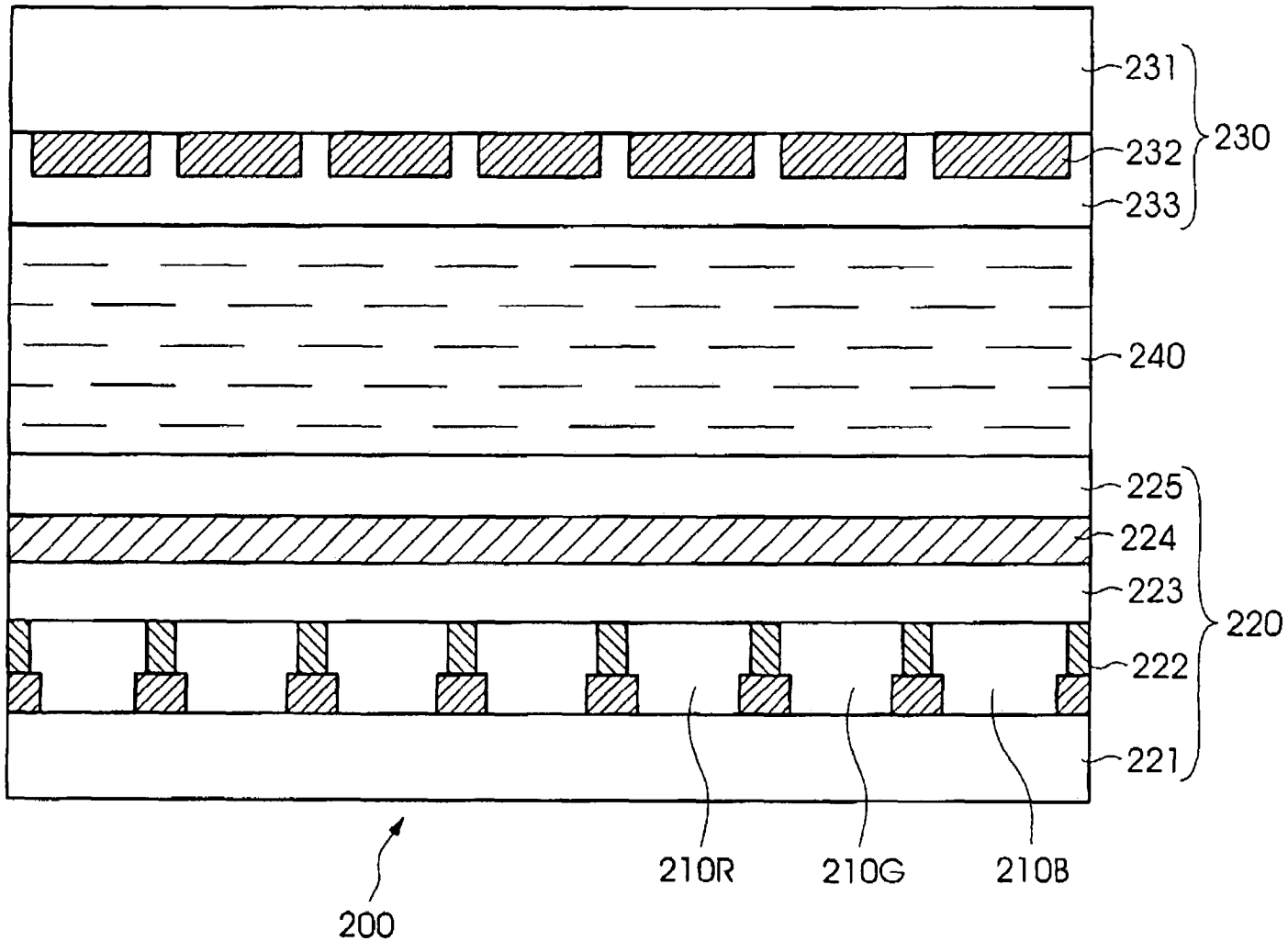
FIG. 8 is a cross section of a liquid crystal device having a color filter base board which is manufactured by the liquid drop ejecting device 1 shown in FIG. 1.
Figure 9A:
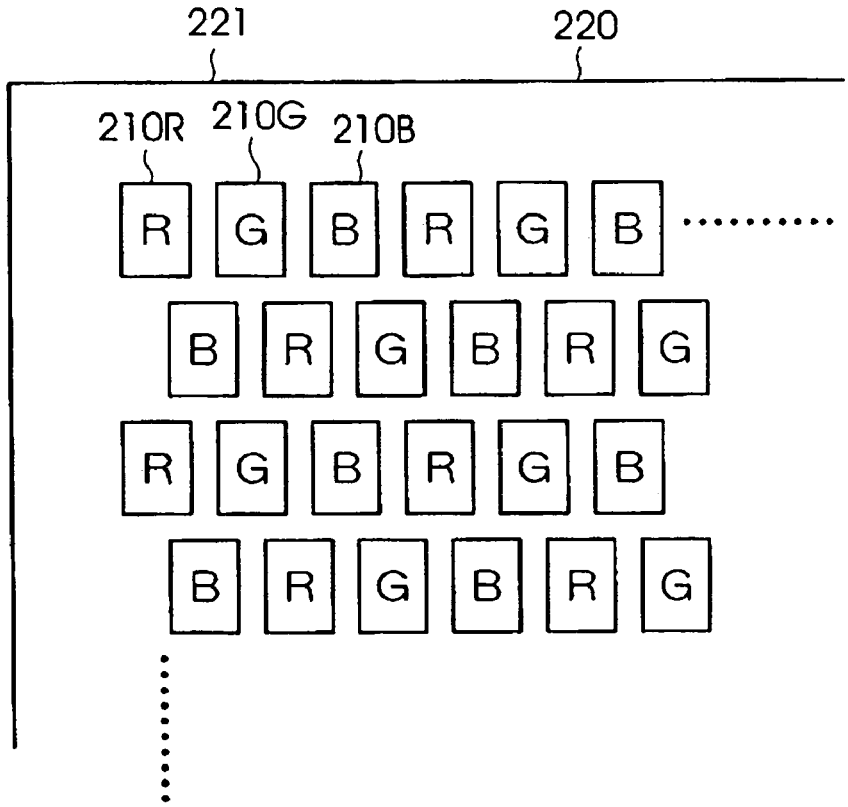
FIGS. 9A and 9B are views for explaining a disposition for colors on the color filter base board.
Figure 9B:
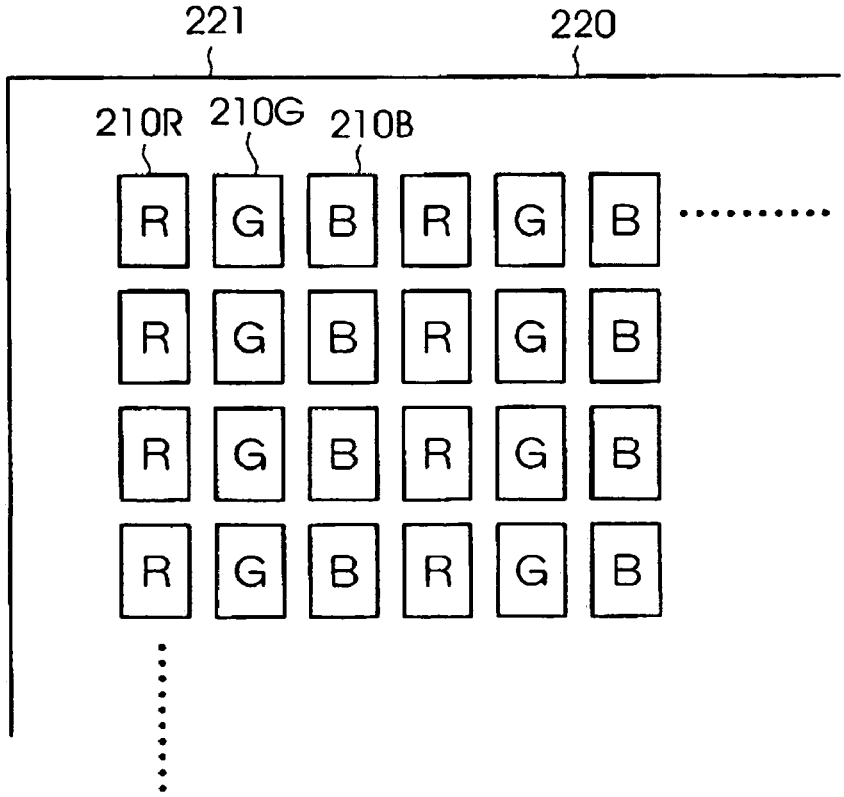

FIG. 8 is a cross section for a liquid crystal device which uses a color filter base board which is manufactured by using the liquid drop ejecting device 1 shown in FIG. 1. FIGS. 9A and 9B are views for explaining a disposition for colors on the color filter base board. In a liquid crystal device 200 shown in FIG. 8, a color filter base board 220 and a TFT array base board 230 are attached together so as to have a predetermined interval therebetween. Simultaneously, an electro-optical member such as a liquid crystal 240 is sealed between these base boards. The TFT (not shown in the drawing) for serving a pixel switching function and a pixel electrode 232 are disposed in a matrix manner on an inner surface of the transparent base board 231 on the TFT array base board 230. An orientation layer is formed on a surface of the transparent base board 231. In contrast, color filter layers 210R, 210G, and 210B which represent colors such as red (R), green (G), and blue (B) are formed in corresponding positions on a transparent base board 221 in the color filter base board 220 such that the color filter layers 210R, 210G, and 210B face to pixel electrodes 232 respectively. A flat layer 223, a facing electrode 224, and an orientation layer 225 are formed on a surface of the transparent base board 221.

The color filter layers 210R, 210G, and 210B are surrounded by a bank 222 having at least a step section therearound so as to be inside of the bank 222 in the color filter base board 220. Here, the color filter layers 210R, 210G, and 210B can be disposed in predetermined layouts such as a delta-disposition shown in FIG. 9A, a stripe disposition shown in FIG. 9B.

In order to manufacture the color filter base board 220 having above structure, the bank 222 is formed on a surface of the transparent base board 221. After that, resins (liquid drop) having predetermined colors are supplied inside of each bank 222 by using the liquid drop ejecting device 1 which is explained with reference to FIG. 1. After that, the resins are hardened by an ultra-violet ray or thermally so as to form the color filter layers 210R, 210G, and 210B. Therefore, it is possible to form the color filter layers 210R, 210G, and 210B without using a photolithographic technique. Therefore, it is possible to improve the manufacturing efficiency for the color filter base board 220.

EXAMPLE 3 FOR LIQUID DROP EJECTING DEVICE

Figure 10:
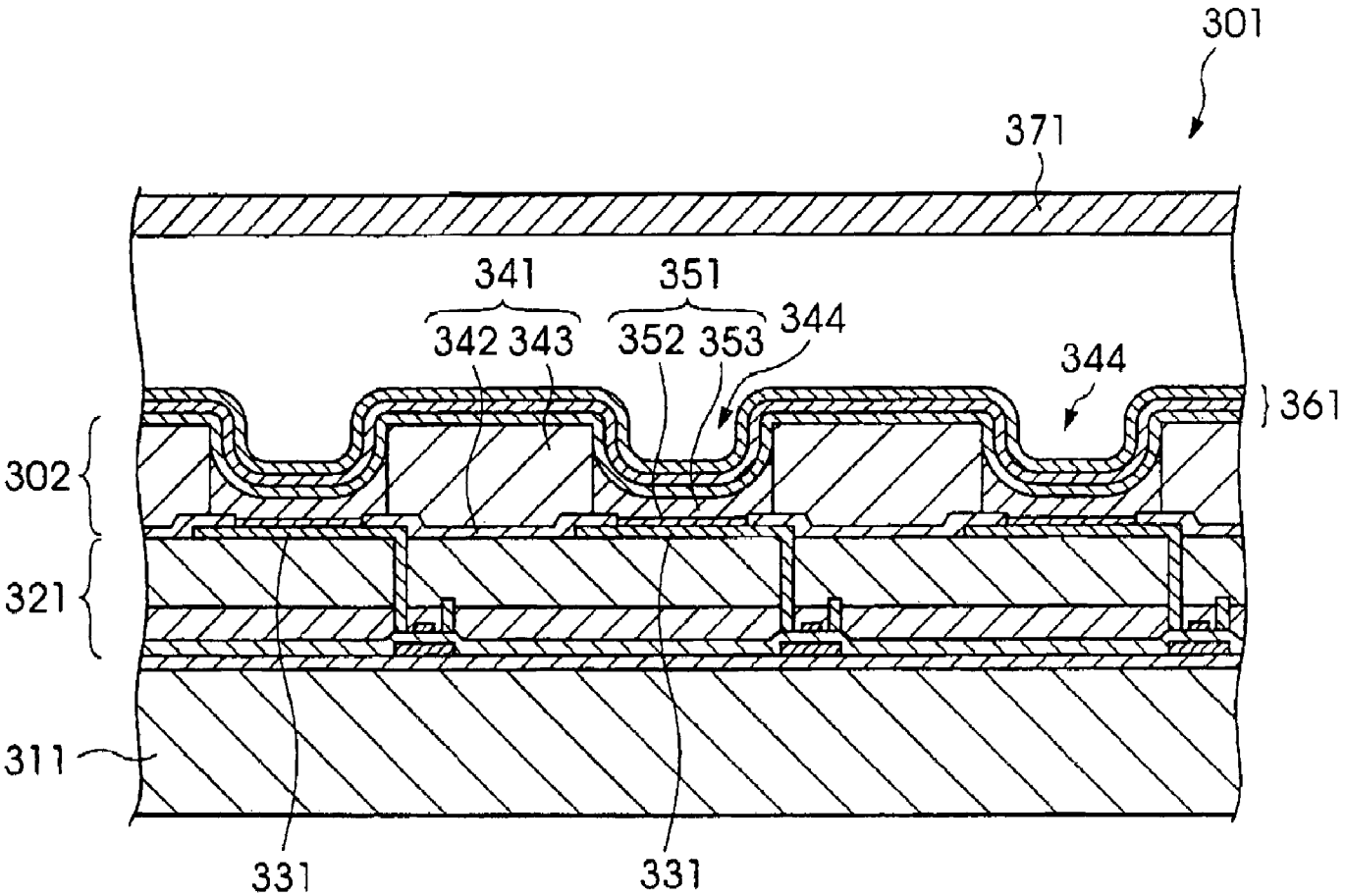
FIG. 10 is a cross section viewing a display device graphically which utilizes an organic EL which is manufactured by using the liquid drop ejecting device 1 which is shown in FIG. 1.

FIG. 10 is a cross section viewing a display device graphically which utilizes an organic EL which is manufactured by using the liquid drop ejecting device 1 which is shown in FIG. 1. An EL display device is a luminescent element which emits a light such as a fluorescence or a phosphorescence which is generated during a deactivation of an exciton which is generated by recombining an electron and a positive hole (hole) by implanting the recombining an electron and a positive hole (hole) into a substrate such that the substrate should contain a fluorescent inorganic and organic compound which are sandwiched by a cathode and an anode. These fluorescent members in red, green, and blue which are used for the EL display device are patterned by ejecting the liquid drop on an element base board such as a TFT by using a device for manufacturing a device according to the present invention. By doing this, it is possible to manufacture a full-color luminescent EL display device.

It should be understood that the device of the present invention should contain a base board which is used for such an EL display device. As shown in the drawing, an organic EL element 302 is connected to a wiring on a flexible base board (not shown in the drawing) and a driving IC (not shown in the drawing) in an organic EL device 301. Here, the organic EL element 302 comprises a base board 311, a circuit element section 321, a pixel electrode 331, a bank section 341, a luminescent element 351, a cathode 361 (facing electrode), and a sealing base board 371. The circuit element section 321 is formed on the base board 311 such that a plurality of pixel electrodes 331 are disposed in arrays on the circuit element section 321. Consequently, the bank section 341 is formed in a matrix manner between the pixel electrodes 331. The luminescent element 351 is formed in a convex aperture 344 which is formed by the bank section 341. The cathode 361 is formed on an entire upper surface of the bank section 341 and the luminescent element 351 such that the sealing base board 371 is layered on the cathode 361.

A process for manufacturing the organic EL device 301 which contains the organic EL element comprises the steps for forming the bank section 341, performing a plasma-processing operation for forming the luminescent element 351 properly, forming the luminescent element 351, forming a facing electrode such as the cathode 361, and layering the sealing base board 371 on the cathode 361 so as to seal the cathode 361 by the sealing base board 371. The above liquid drop ejecting device 1 is used for forming members such as the bank section 341 and the luminescent element 351.

In a step for forming the luminescent element 351, the convex aperture 344 such as a positive hole implanting/transmitting layer 352 and a luminescent layer 353 is formed on the pixel electrode 331 so as to form the luminescent element 351. That is, the step for forming the luminescent element 351 comprises the steps for forming the positive hole implanting/transmitting layer 352 and forming the luminescent element 351. In addition, the step for forming the positive hole implanting/transmitting layer 352 comprises the steps for ejecting a first composition for forming the positive hole implanting/transmitting layer 352 onto each pixel electrode 331 and drying the first composition. The step for forming the luminescent element 351 the steps for ejecting a second composition (a functional liquid) for forming a luminescent layer 353 onto the positive hole implanting/transmitting layer 352 and drying secondarily the ejected second composition so as to form the luminescent layer 353.

The above liquid crystal device and an organic EL element are disposed in a an electronic apparatus such as a notebook computer and a mobile phone. Here, it should be understood that the electronic apparatus of the present invention not be limited to only the above notebook computer and the mobile phone; therefore, it is possible to use the electronic apparatus of the present invention in various electronic apparatuses. For example, it is possible to use the electronic apparatus of the present invention in various electronic apparatuses such as a liquid crystal projector, a multi-media personal computer (PC), an engineering work station (EWS), a pager, a word processor, a television, a video-tape-recorder having a view finder or a view monitor, a personal digital assistance, an electronic desktop calculator, a car-navigation device, a POS terminal, and devices having a touch panel.

What is claimed is:

1. A liquid drop ejecting device comprising:

a liquid drop ejecting head device having:

a liquid drop ejecting head ejecting a liquid drop;

a detachable storage section arranged in the liquid drop ejecting head device, being detachable from the liquid drop ejecting head device, and storing at least one of record data indicating whether or not the liquid drop is ejected from the liquid drop ejecting head device; and a storage controlling section arranged in the liquid drop ejecting head device, reading out at least one of the record data from the detachable storage section and/or writing at least one of the record data to the detachable storage section; and a controlling device arranged separate from the liquid drop ejecting head device, coupled to the liquid drop ejecting head device, and transmitting, to the liquid drop ejecting head device, the record data and a driving waveform driving the liquid drop ejecting head.

2. A liquid drop ejecting device according to claim 1, wherein the liquid drop ejecting head device controls the liquid drop ejecting head according to the driving waveform which is transmitted from the controlling device and the record data which is read from the detachable storage section by the storage controlling section.

3. A liquid drop ejecting device according to claim 1, wherein the controlling device transmits a part of the record data or an entire record data to the liquid drop ejecting head device before the liquid drop ejecting head device ejects the liquid drop such that the record data be stored in the storage section by the storage controlling section.

* * * * *